US009353452B2

(12) United States Patent
Takahashi et al.

(10) Patent No.: US 9,353,452 B2
(45) Date of Patent: May 31, 2016

(54) METHOD OF SEPARATING AND RECOVERING METALS AND SYSTEM FOR SEPARATING AND RECOVERING METALS

(71) Applicant: Kabushiki Kaisha Toshiba, Minato-ku (JP)

(72) Inventors: Yuya Takahashi, Kawasaki (JP); Hitoshi Nakamura, Yokohama (JP); Shohei Kanamura, Kawasaki (JP); Akira Yamada, Setagaya-ku (JP); Koji Mizuguchi, Kawasaki (JP); Takashi Oomori, Adachi-ku (JP)

(73) Assignee: KABUSHIKI KAISHA TOSHIBA, Minato-ku (JP)

( * ) Notice: Subject to any disclaimer, the term of this patent is extended or adjusted under 35 U.S.C. 154(b) by 0 days.

(21) Appl. No.: 14/323,066

(22) Filed: Jul. 3, 2014

(65) Prior Publication Data

US 2015/0008136 A1 Jan. 8, 2015

(30) Foreign Application Priority Data

Jul. 5, 2013 (JP) ..... 2013-141820

(51) Int. Cl.

| | |
|---|---|
| ***C25C 3/00*** | (2006.01) |
| ***C25C 3/26*** | (2006.01) |
| ***C25C 3/34*** | (2006.01) |
| ***C25C 7/06*** | (2006.01) |

(52) U.S. Cl.

CPC ... *C25C 7/06* (2013.01); *C25C 3/26* (2013.01); *C25C 3/34* (2013.01)

(58) Field of Classification Search

CPC ..... C25C 3/00; C25C 3/26
USPC ..... 205/81, 336
See application file for complete search history.

(56) References Cited

U.S. PATENT DOCUMENTS

| | | | | |
|---|---|---|---|---|
| 7,632,384 | B1 * | 12/2009 | Redey | G01N 27/416 204/408 |
| 2011/0100831 | A1 * | 5/2011 | Jha | C25C 3/00 205/336 |
| 2014/0291161 | A1 * | 10/2014 | Awazu | C25C 3/34 205/348 |

FOREIGN PATENT DOCUMENTS

| | | |
|---|---|---|
| JP | 2013-088117 | 5/2013 |

* cited by examiner

*Primary Examiner* — James Lin
*Assistant Examiner* — Leo Ahnn
(74) *Attorney, Agent, or Firm* — Oblon, McClelland, Maier & Neustadt, L.L.P.

(57) ABSTRACT

According to one embodiment, a method of separating and recovering metals whereby a mixture containing at least a first metal and a second metal, the second metal having a higher standard electrode potential than that of the first metal, is connected to an anode in a molten salt, and the first metal and the second metal are precipitated on a cathode in the molten salt by electrolysis, the method of separating and recovering metals comprising: a detection step of detecting a concentration change in each of a first metal ion and a second metal ion in the molten salt by a concentration change detection unit; a first electrolysis step of electrolyzing the first metal; a first recovery step of recovering a precipitated substance according to a detection in which a concentration decrease of the first metal ion, which is predefined in the concentration change detection unit, is detected in the detection step; a second electrolysis step of electrolyzing the second metal; and a second recovery step of recovering a precipitated substance subsequent to the first recovery step.

10 Claims, 9 Drawing Sheets

TRANSITION PERIOD

Zr CONCENTRATION
S3
TIME

Fe CONCENTRATION
S5
TIME
S1
S4
S2

ANODE POTENTIAL
t2
t4
t1
t3
TIME

CURRENT VALUE
TIME

METHOD OF SEPARATING AND RECOVERING METALS AND SYSTEM FOR SEPARATING AND RECOVERING METALS

CROSS-REFERENCE TO RELATED APPLICATIONS

This application is based upon and claims the benefit of priority from Japanese Patient application No. 2013-141820, filed on Jul. 5, 2013, the entire contents of each of which are incorporated herein by reference.

BACKGROUND OF THE INVENTION

1. Field of the Invention

Embodiments of the present invention relate to a method of separating and recovering metals and a system for separating and recovering metals.

2. Description of the Related Art

When an atomic power plant loses its cooling capability due to a nuclear accident, there is possibility that the fuel assembly and the reactor core structure are heated to be melted by decay heat of the nuclear fuel, thereby producing a molten core material. In the molten core material, there coexist non-uniformly various materials, such as iron based materials constituting reactor internal structures etc., zirconium material which is a material for cladding tubes and channel boxes, oxide fuels such as uranium oxide and plutonium oxide contained in the nuclear fuel, and the like.

The cost and labor to store and manage radioactive wastes increase as the amount of the wastes increases. Accordingly, when treating the molten core material as a radioactive waste, there is a demand for a method of separating and recovering components other than radioactive wastes, thereby reducing the amount to be managed and stored as a high-level radioactive waste; see Japanese Patent Application Laid-Open Publication No. 2013-88117A.

SUMMARY OF THE INVENTION

It is an objective of the present invention to provide a method of separating and recovering metals and a system for separating and recovering metals, for efficiently separating and recovering desired metals from a solid containing a plurality of metals, such as a molten core material.

To achieve the above described objective, a method of separating and recovering metals according to an embodiment is a method of separating and recovering metals whereby a mixture containing at least a first metal and a second metal, the second metal having a higher standard electrode potential than that of the first metal, is connected to an anode in a molten salt, and the first metal and the second metal are precipitated on a cathode in the molten salt by electrolysis, the method of separating and recovering metals comprising: a detection step of detecting a concentration change in each of a first metal ion and a second metal ion in the molten salt by a concentration change detection unit; a first electrolysis step of electrolyzing the first metal; a first recovery step of recovering a precipitated substance according to a detection in which a concentration decrease of the first metal ion, which is predefined in the concentration change detection unit, is detected in the detection step; a second electrolysis step of electrolyzing the second metal; and a second recovery step of recovering a precipitated substance subsequent to the first recovery step.

Further, to achieve the above described objective, a system for separating and recovering metals according to an embodiment is a system for separating and recovering metals in which a mixture containing at least a first metal and a second metal, the second metal having a higher standard electrode potential than that of the first metal, is electrolyzed in a molten salt, thereby the first metal and the second metal are precipitated and recovered, the system for separating and recovering metals comprising: an electrolysis vessel for containing a molten salt; an anode provided in the molten salt in the electrolysis vessel and being connected with a target object; a cathode provided in the molten salt in the electrolysis vessel; a concentration change detection unit for detecting a concentration change in each of a first metal ion and a second metal ion in the molten salt; and a precipitated substance recovery unit for recovering a precipitated substance which is precipitated on the cathode based on information of the concentration change detection unit, wherein upon detection of a predefined decrease in the concentration of the first metal ion in the molten salt, the concentration change detection unit transmits a recovery signal to the precipitated substance recovery unit according to the detection, and the recovery unit recovers a precipitated substance, which is produced at the cathode, based on the recovery signal.

DETAILED DESCRIPTION OF THE PREFERRED EMBODIMENTS

Hereafter, embodiments of the present invention will be described with reference to the drawings.

First Embodiment

Figures 2A, 2B, 2C, 2D:
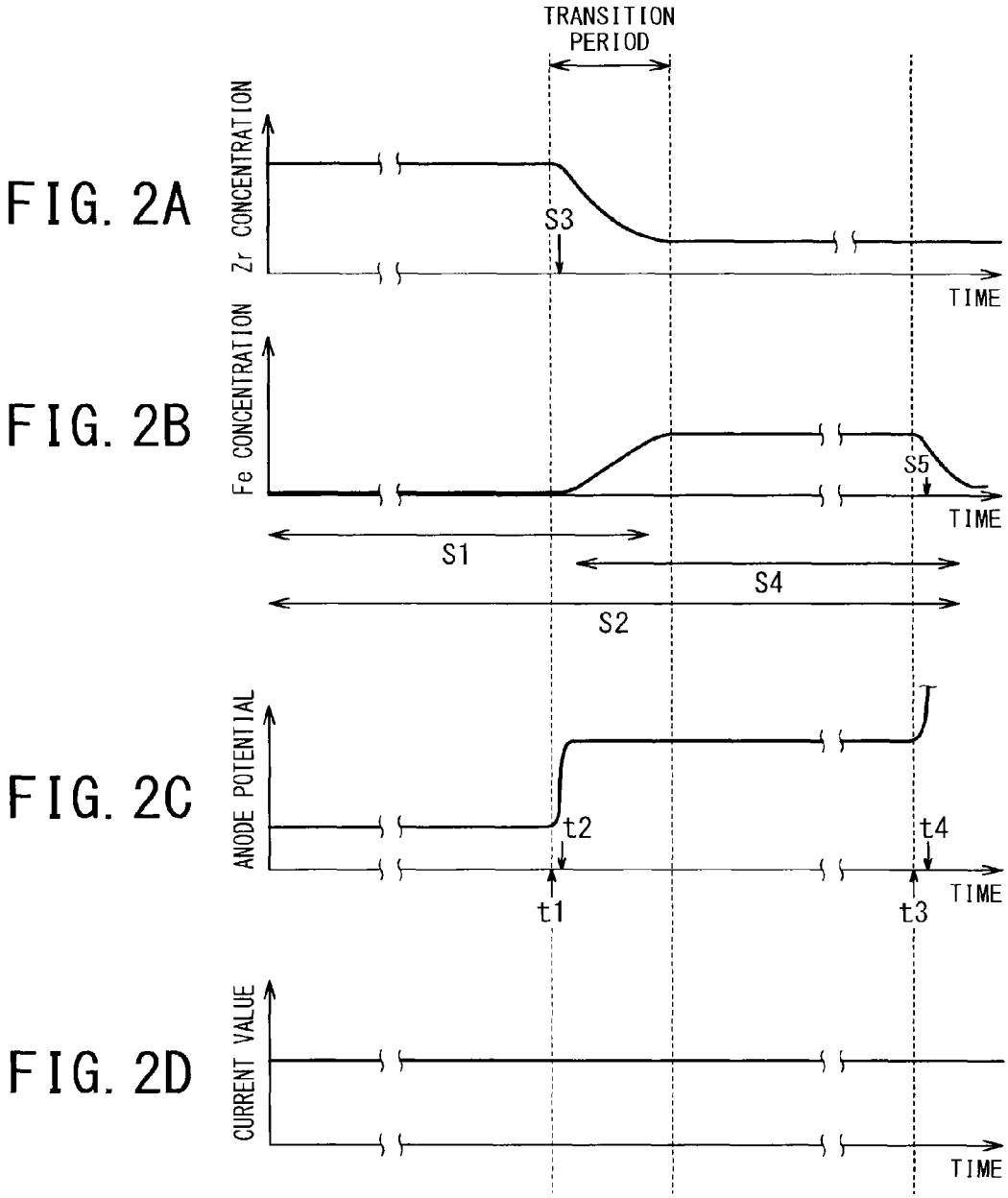
FIG. 2A shows graphs of concentration change of Zr ion in an electrolysis vessel in the first embodiment.
FIG. 2B shows graphs of concentration change of Fe ion in the electrolysis vessel in the first embodiment.
FIG. 2C shows graphs of change in anode potential in the first embodiment.
FIG. 2D shows graphs of current flowing between the anode and the cathode in the first embodiment.
Figure 3:
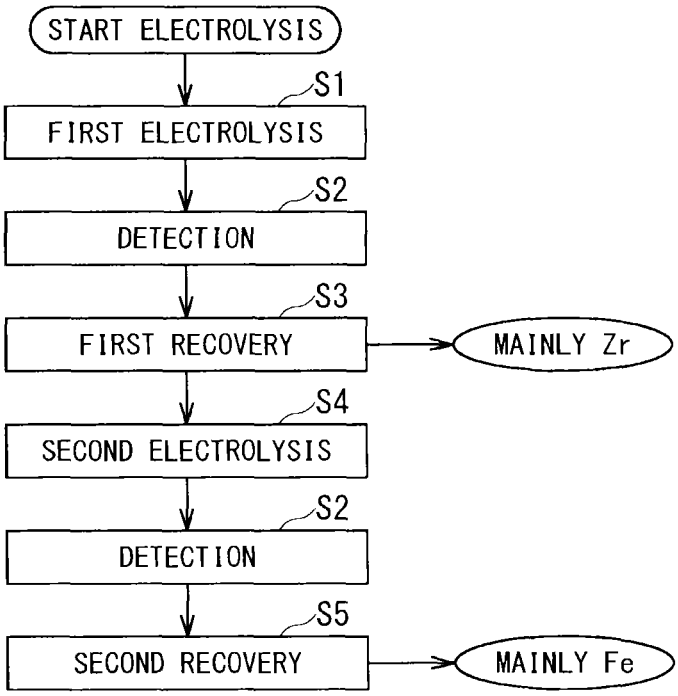
FIG. 3 is a flowchart of the method of separating and recovering metals in the first embodiment.

A method of separating and recovering metals and a system for separating and recovering metals of a first embodiment will be described by using FIGS. 1 to 3.

(Target Object)

A target object to be subjected to separation and recovery of metals is one which contains at least two kinds of metals. Each metal may be present in the target object in a uniformly mixed state, or may be present in a non-uniform state. Moreover, there is a noble-base relationship between metals in the target object in association with respective standard electrode potentials inherent to them. A metal having a higher standard electrode potential is referred to as a noble metal, and a metal having a lower standard electrode potential is referred to as a base metal.

In the present embodiment, the target object is molten fuel containing Fe and Zr, and Fe and Zr are to be separated and recovered. Fe has a higher standard electrode potential than that of Zr, and Fe is a noble metal with respect to Zr, and Zr is a base metal with respect to Fe. Metals like Fe and Zr, which are contained in the target object and become targets for recovery, are referred to as target metals for recovery.

Generally, molten fuel contains large amounts of Zr and Fe. To reduce the amount of the portion of molten fuel which is to be stored and managed as a high-level radioactive waste, it is desirable that Fe and Zr are separated from the molten fuel to be stored and managed as a low-level radioactive waste. Further, when the radiation doses of separated Fe and Zr are sufficiently low, they may possibly be reused as the material for reactor internal structures and fuel cladding tubes.

(Electrolysis Reaction)

The separation and recovery of metals of the present embodiment is performed by way of molten salt electrolytic treatment. In a molten salt electrolysis reaction, when for a metal which is connected to the anode, the anode potential is higher than the standard electrode potential and the cathode potential is lower than the standard electrode potential, the metal is oxidized at the anode to become an ion to be dissolved into the molten salt, and is reduced to be precipitated at the cathode. Further, when a mixture of different metals is connected to the anode, a base metal having a lower standard electrode potential is electrolyzed first, thereby being dissolved and then precipitated. In the case of the target object, Zr is dissolved and precipitated earlier than Fe.

Figure 1:
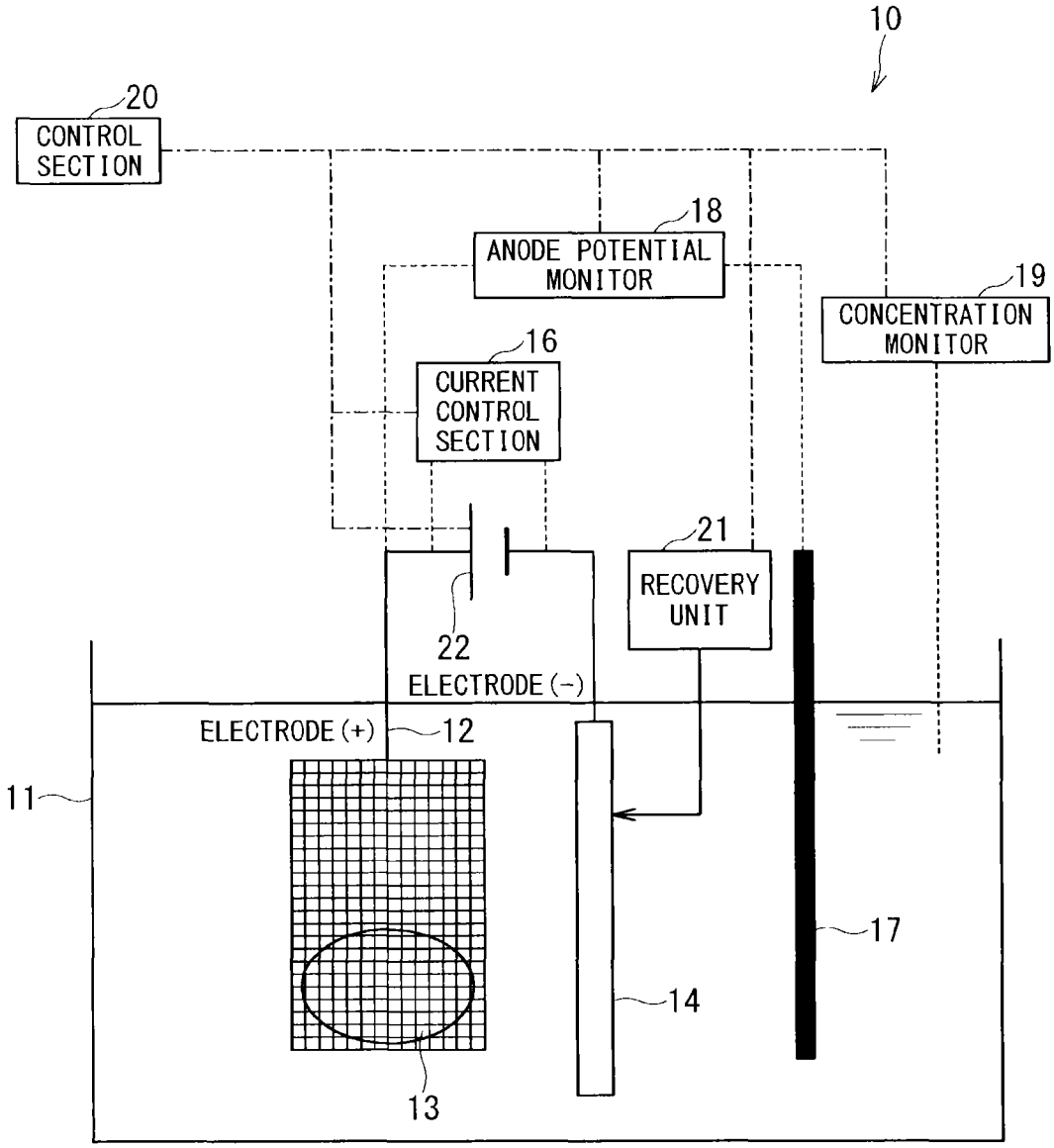
FIG. 1 is a schematic view of an apparatus for separating and recovering metals in a first embodiment.

Here, FIG. 1 is a schematic view of an apparatus for separating and recovering metals in the present embodiment. An apparatus 10 for separating and recovering metals has an anode 12 and a cathode 14 in an electrolysis vessel 11, and the anode 12 is connected with a target object 13. FIG. 2A is a graph of concentration change of Zr ion in the electrolysis vessel in the first embodiment, FIG. 2B is a graph of concentration change of Fe ion in the electrolysis vessel in the first embodiment, FIG. 2C is a graph of change in the anode potential in the first embodiment, and FIG. 2D is a graph of the current flowing between the anode and the cathode in the first embodiment. In the present embodiment, the current value between electrodes is controlled so as to be always constant. FIG. 3 is a flowchart of the method of separating and recovering metals in the present embodiment.

The molten salt electrolytic treatment in the present embodiment will be described by mainly using FIG. 2. When electrolysis is started by applying voltage between electrodes, Zr, which is baser with respect to Fe, will be first electrolyzed to be dissolved and precipitated. Accordingly, for some time after the start of electrolysis, an equilibrium is maintained with the concentration of Zr ion in the molten salt being kept high. At this time, the amount of Zr that is dissolved at the anode is balanced with the amount of Zr that is precipitated at the cathode. The concentration of Zr ion in the molten salt will be constant until Zr connected to the anode side is depleted. Moreover, while Zr ion concentration in the molten salt is constant, the potential of the anode 12 is constant as well.

After a while, if Zr in the target object 13 connected to the anode 12 is depleted, the Zr concentration in the molten salt turns to a decrease. Although the current density between electrodes decreases as the result of decrease in the Zr concentration in the molten salt, the potential of the anode 12 increases since the current value between the electrodes is controlled at a constant current. Thus, a process in which Zr is electrolyzed as described above is referred to as a first electrolysis step S1.

It is noted that a salt of Zr is added in advance in the molten salt such that the precipitation of a metal which is baser than Zr is suppressed and electrolysis of Zr is started without delay immediately after the start of electrolysis. As a result of that, the concentration of Zr ion is constant from immediately after the start of electrolysis in FIG. 2A, and the anode potential is constant from immediately after the start of electrolysis in FIG. 2C as well.

As a result of the depletion of Zr connected to the anode 12, the potential of the anode 12 increases, and the electrolysis of Fe is started. Along with the start of the electrolysis of Fe, the concentration of Fe ion in the molten salt increases, and when the amount of dissolution and the amount of precipitation come into balance, the Fe ion concentration in the molten salt reaches an equilibrium to become constant. After the start of the electrolysis of Fe and until the Fe connected to the anode 12 is depleted, the potential of the anode 12 remains constant. Then, when the Fe in the target object 13 connected to the anode 12 is depleted, the Fe concentration in the molten salt turns to a decrease. In that case, the potential of the anode 12 increases as in the case of Zr. The process in which Fe is electrolyzed as described so far is referred to as a second electrolysis step S4.

The period from when the concentration of Zr ion turns to a decrease in the first electrolysis step S1 until the concentration of Fe ion increases to reach an equilibrium in the second electrolysis step S4 is referred to as a transition period. In the transition period, a last stage of the electrolysis step S1 and an early stage of the second electrolysis step S4 are overlapped.

Hereafter, the transition period in the molten salt electrolytic treatment of the present embodiment will be described. It is supposed that the time at which the Zr ion concentration turns to a decrease from an equilibrium indicates the start of the transition period. In the vicinity of the anode 12 immediately after the start of the transition period, since Zr in the target object 13 is depleted, the concentration of Zr ion becomes substantially zero, and on the other hand, the concentration of Fe ion increases since Fe starts to be dissolved. Moreover, Zr ions which have not been precipitated remain in the vicinity of the cathode, and Fe ions have not reached the vicinity of the cathode 14. For that reason, in the early stage of the transition period, dissolution of Fe is making progress at the anode 12, and precipitation of Zr is continuing at the cathode 14.

As the transition period proceeds, the concentration of Fe ion in the molten salt increases, and the concentration of Fe ion starts increasing even in the vicinity of the cathode. Then, the amount of Zr that is precipitated at the cathode 14 decreases, and the amount of Fe that is precipitated at the cathode 14 increases.

If the amount of Fe that is dissolved at the anode comes into balance with the amount of Fe that is precipitated at the cathode, the concentration of Fe ion in the molten slat reaches an equilibrium to be constant. It is supposed that the time at which the Fe ion concentration in the molten salt turns from an increase to an equilibrium indicates the end of transition period.

Here, a precipitated substance will be described. Before the start of the transition period, mainly Zr is precipitated. And after the end of the transition period, mainly Fe is precipitated. Further, since electrolysis of Zr and Fe occurs during the transition period, Zr and Fe coexist in the precipitated substance. It is noted that after the end of the transition period, mainly Fe is precipitated even if Zr ion remains in the molten salt since Fe is a nobler metal and is more likely to be precipitated.

(Electrolysis Apparatus)

Next, a system 10 for separating and recovering metals of the present embodiment will be described by using FIG. 1. The system 10 for separating and recovering metals is an electrolysis apparatus for performing molten salt electrolytic treatment, and includes an electrolysis vessel 11 for containing a molten salt. An anode 12 provided in a molten salt is a basket made of an electrical conductor which is nobler than a first metal and a second metal, and a target object 13 is provided in the basket. The basket is made of nickel or carbon in the present embodiment. A cathode 14 provided in the molten salt may be any electrical conductor and can be made of stainless steel other than nickel and carbon.

The anode 12 and the cathode 14 are applied with voltage by a power supply 22, and are controlled by a current control section 16 such that a current value that flows between both electrodes is constant. Moreover, the potential difference between the anode 12 and the cathode 14 is measured by an interelectrode potential monitor which is not shown.

Moreover, a reference electrode 17 for measuring the potential of the anode 12 is provided in the molten salt, and an anode potential monitor 18 measures the potential of the anode 12 from a potential difference with respect to the reference electrode 17. The potential of the anode 12 is affected by the concentration change of the target metal ion for recovery in the molten salt. For that reason, in the present embodiment, it is possible to detect the concentration change of the target metal ion for recovery in the molten salt by the anode potential monitor 18.

Moreover, the electrolysis apparatus 10 is provided with a concentration monitor 19 for measuring the concentration of the target metal ion for recovery in the molten salt. The concentration monitor 19 determines the concentration of the target metal ion for recovery in the molten salt by, for example, periodically sampling the molten salt and performing component analysis and spectroscopy.

It is possible to detect the concentration change of the target metal ion for recovery in the molten salt from the concentration of the target metal ion for recovery by the concentration monitor 19.

It is noted that all of the current control section 16, the interelectrode potential monitor, the anode potential monitor 18, and the concentration monitor 19 are connected to a control section 20. The control section 20 controls the operation of a recovery unit 21 for recovering a precipitated substance which occurs at the cathode based on the information of the anode potential monitor 18 and the concentration monitor 19. Moreover, the control section 20 controls the operation of the power supply 22 and the current control section 16 to control ON/OFF of the molten salt electrolytic treatment based on the information of the anode potential monitor 18 and the concentration monitor 19.

The recovery unit 21 is, for example, a unit for replacing the cathode 14, onto which a precipitated substance has adhered, with an electrode onto which no precipitated substance has adhered. Alternatively, it may be a unit for detaching the precipitated substance from the cathode 14, or a unit for recovering the precipitated substance that has been detached from the cathode 14 and settled. Also, it may be a combination of those plurality of recovery units.

Next, the relationship between the anode potential monitor 18 and the control section 20 will be described. The information of the potential of the anode 12 measured by the anode potential monitor 18 is transmitted to the control section 20, and the control section 20 monitors the potential of the anode 12. The potential of the anode 12 increases as a result of that the concentration of metal ion during electrolysis decreases.

Accordingly, the control section 20 can detect a concentration decrease of targeted metal ion from the information of the anode potential monitor 18 by storing in advance the increase in the anode potential, which corresponds to the concentration decrease of the targeted metal ion, in the control section 20. Thus, the control section 20 can detect the starting time point of the transition period, and the time point at which the Fe ion concentration turns to a decrease.

Next, the relationship between the concentration monitor 19 and the control section 20 will be described. The information of the concentration of each target metal ion for recovery in the molten salt, which is measured by the concentration monitor 19, is transmitted to the control section 20, and the control section 20 monitors the concentration and changes of each target metal ion for recovery.

For that reason, the control section 20 can detect the start of the transition period from the information of the concentration monitor 19 by presetting the change of the concentration of Zr ion, which corresponds to the time at which the concentration of Zr ion in the molten salt turns to a decrease from an equilibrium, in the control section 20. Similarly, the control section 20 can detect the time point at which Fe on the anode 12 side starts depleting from the information of the concentration monitor 19 by presetting, in the control section 20, the change of the concentration of Fe ion when the concentration of Fe ion in the molten salt turns to a decrease from an equilibrium.

Further, the control section 20 can detect the end of the transition period by presetting in the control section 20 the change of Fe ion concentration when the concentration of Fe ion in the molten salt turns to an equilibrium from an increase.

It is noted that the control section 20 may be provided separately from the anode potential monitor 18 and the concentration monitor 19, or may be incorporated into the anode potential monitor 18 and the concentration monitor 19, respectively.

The configuration necessary for detecting the concentration change of target metal ions for recovery in the molten salt, such as the anode potential monitor 18, the concentration monitor 19, and control section 20, are generically referred to as a concentration change detection unit.

Next, the molten salt to be used in the present embodiment will be described. Performing electrolysis in a molten salt makes it possible to efficiently electrolyze metals which have higher ionization tendency, such as Zr and Fe. The molten salt to be used in the present embodiment is supposed to be, for example, a molten material of a salt such as NaCl, KCl, RbCl, CsCl, $MgCl_2$, NaF, KF, LiF, and NaF. Moreover, the molten salt may not be a single salt, but a mixed salt thereof. For example, it includes combinations of NaCl—KCl, RbCl—NaCl, CsCl—NaCl, RbCl—KCl, CsCl—KCl, NaCl—$MgCl_2$, NaCl—$CaCl_2$, KCl—$SrCl_2$, KCl—$CaCl_2$, NaF-KF, LiF—KF, NaF—LiF, NaCl—NaFKCl—KF, and the like. Further, the molten salt may be a molten salt in which three or more kinds of salts are mixed. It is noted that the molten salt to be used in the present embodiment is NaCl—KCl, whose temperature is around 700 degrees.

(Methodology)

Next, the method of separating and recovering metals will be described by using FIGS. 2 and 3. First, electrolysis is started by applying voltage between the electrodes, and a first electrolysis step S1 is performed. The current value between the electrodes during electrolysis is controlled by the current control section 16. The process in which the current control section 16 controls the current value between the anode 12 and the cathode 14 is referred to as a current control step. Moreover, the process in which the concentration change of the target metal ion for recovery is detected by the concentration change detection unit is referred to as a detection step S2. During the molten salt electrolytic treatment, the detection step S2 is performed as needed.

As the first electrolysis step S1 progresses, the Zr ion concentration in the molten salt turns to a decrease and the start of a transition period is detected by the detection step S2. The time at which the start of the transition period is detected is let to be time t1.

When the start of the transition period is detected, the control section 20 transmits without delay a recovery signal to the recovery unit 21, and the recovery unit 21 recovers a precipitated substance on the cathode 14 side. The start of the transition period, that is, the step in which a concentration decrease of Zr ion, which is preset in the concentration change detection unit, is detected in the detection step S2, and the precipitated substance is recovered according to the detection is referred to as a first recovery step S3. The time at which the first recovery step S3 is carried out is let to be time t2. In the present embodiment, time t2 is preferably immediately after time t1, and is supposed to be at least before the concentration of Fe ion reaches an equilibrium.

Although the start of the transition period is almost concurrent with the start of the second electrolysis step S4, not many Fe ions have reached the cathode immediately after time t1. For that reason, the amount of Fe which is contained in the recovered substance in the first recovery step S3 is small, so that it is possible to recover high purity Zr in the first recovery step S3.

After the first recovery step S3, the Fe ion in the molten salt turns to an equilibrium state from an increase, leading to an end of the transition period. The second electrolysis step S4 is continued even thereafter, and soon the Fe on the anode 12 side is depleted so that the Fe ion concentration in the molten salt turns to a decrease. The time at which a concentration decrease of Fe ion is detected in the detection step S2 is let to be time t3.

Upon detecting a depletion of Fe, the control section 20 transmits without delay a recovery signal to the recovery unit 21, and the recovery unit 21 recovers the precipitated substance on the cathode 14 side. That is, the step in which a concentration decrease of Fe ion, which is preset in the concentration change detection unit, is detected in the detection step S2, and a precipitated substance is recovered according to the detection is referred to as a second recovery step S5. The time at which the second recovery step S5 is carried out is let to be time t4. Although a majority of the recovered substance in the second recovery step S5 is Fe, it partly contains Zr since it contains the precipitated substance of the transition period.

Moreover, before or after the second recovery step S5, the control section 20 transmits a stop signal to the power supply 22 and the current control section 16 to terminate the molten salt electrolytic treatment.

(Advantageous Effects)

In the present embodiment it is possible to continuously and efficiently recover each component from a target object containing a plurality of metals in the same electrolysis vessel, and since a precipitated substance is recovered without delay after the start of the transition period, high purity Zr can be obtained.

It is noted that in the present embodiment, the detection of the concentration change of target metal ion for recovery in the detection step S2 may be based on the measured value of the anode potential monitor 18, or on the measured value of the concentration monitor 19. For that reason, the system 10 for separating and recovering metals is supposed to include at least one of the anode potential monitor 18 and the concentration monitor 19.

Moreover, when both of the anode potential monitor 18 and the concentration monitor 19 are provided, the concentration change of the target metal ion for recovery in the molten salt can be detected more accurately by combining both of those measurement information.

Second Embodiment

Figures 4A, 4B, 4C:
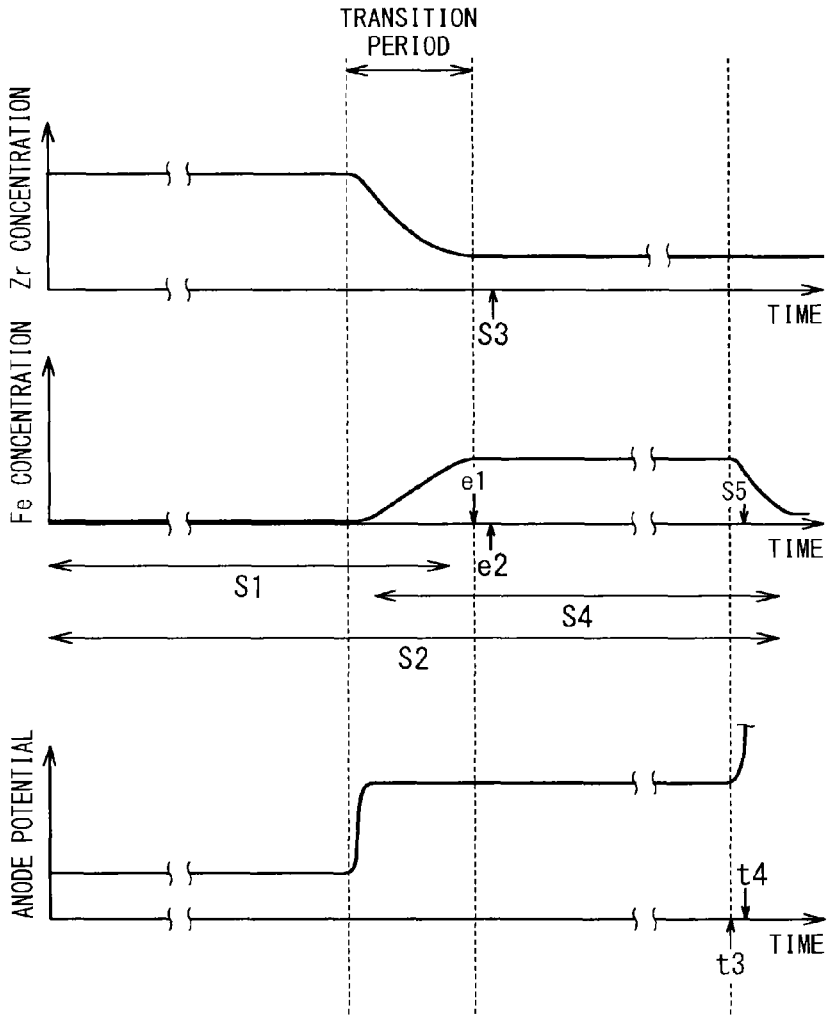
FIG. 4A shows graphs of concentration change of Zr ion in an electrolysis vessel in a second embodiment.
FIG. 4B shows graphs of concentration change of Fe ion in the electrolysis vessel in the second embodiment.
FIG. 4C shows graphs of change in anode potential in the second embodiment.

A second embodiment will be described by using FIGS. 3 and 4. FIG. 4A is a graph of the concentration change of Zr ion in an electrolysis vessel in the second embodiment, FIG. 4B is a graph of the concentration change of Fe ion in the electrolysis vessel in the second embodiment, and FIG. 4C is a graph of the change of anode potential in the second embodiment. It is noted that the same configurations as those of the first embodiment are given the same reference symbols, thereby omitting overlapping description.

(Methodology)

Hereafter, a method of separating and recovering metals of the present embodiment will be described. First, as with the first embodiment, the first electrolysis step S1 is performed. The detection step S2 is performed as needed during molten salt electrolytic treatment.

As electrolysis progresses, the transition period will soon start, and the concentration of Fe ion in the molten salt turns from an increase to an equilibrium in the detection step S2 so that end of the transition period is detected. This time is let to be time e1.

Then, the control section 20 transmits without delay a recovery signal to the recovery unit 21, and the first recovery step S3 is performed at time e2.

After the first recovery step S3, as with the first embodiment, molten salt electrolytic treatment is performed, and it is detected that the concentration change of Fe ion turns from an equilibrium to a decrease at time t3 so that the second recovery step S5 is performed at time t4.

(Advantageous Effects)

In the present embodiment since it is possible to continuously recover each component from a target object containing a plurality of metals in the same electrolysis vessel, and the first recovery step S3 is performed after the end of the transition period, high purity Fe can be recovered.

Further, in the present embodiment, the detection of end of the transition period can be performed by measuring the concentration of Fe ion by the concentration monitor 20 and observing the changes thereof. For that reason, the concentration change detection unit is supposed to include a concentration monitor 19 which can measure the concentration of Fe ion.

Third Embodiment

Figure 5:
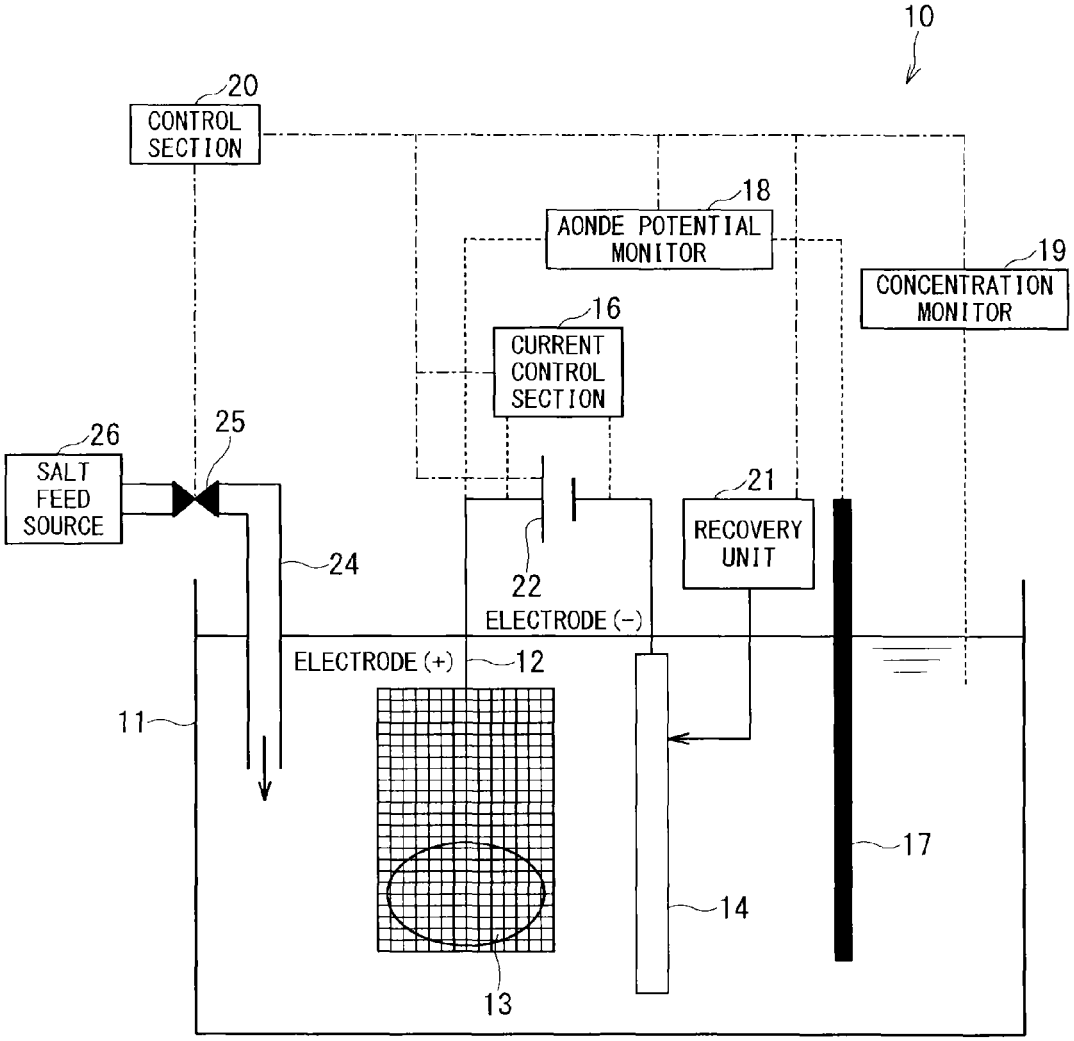
FIG. 5 is a schematic view of an apparatus for separating and recovering metals in a third embodiment.
Figures 6A, 6B, 6C:
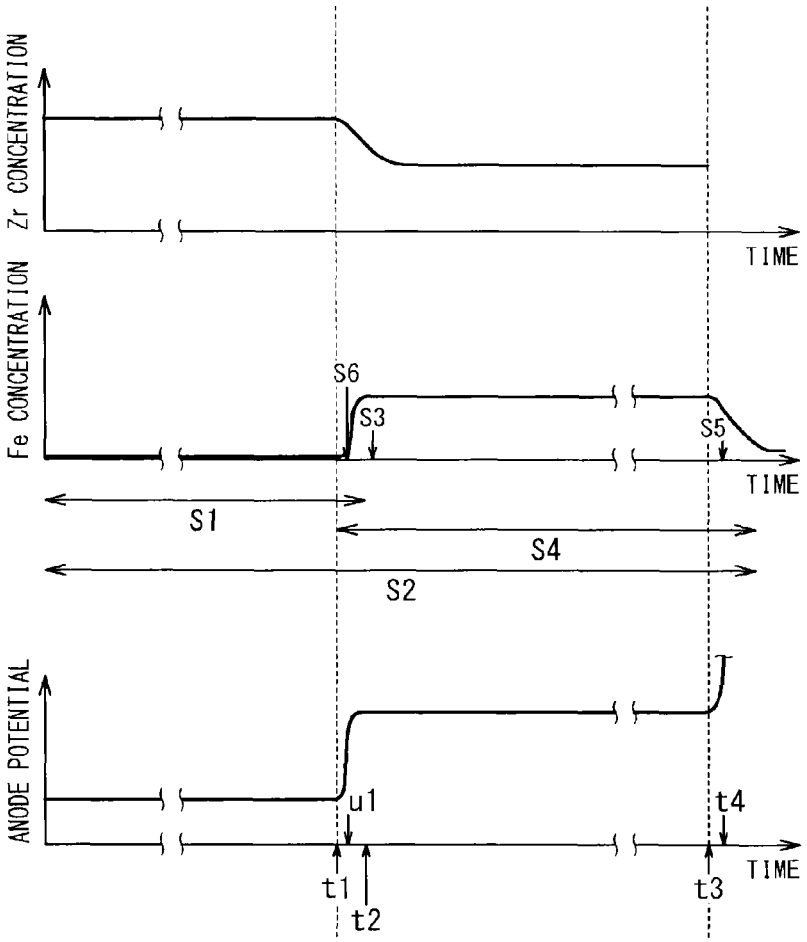
FIG. 6A shows graphs of concentration change of Zr ion in an electrolysis vessel in the third embodiment.
FIG. 6B shows graphs of concentration change of Fe ion in the electrolysis vessel in the third embodiment.
FIG. 6C shows graphs of change in anode potential in the third embodiment.
Figure 7:
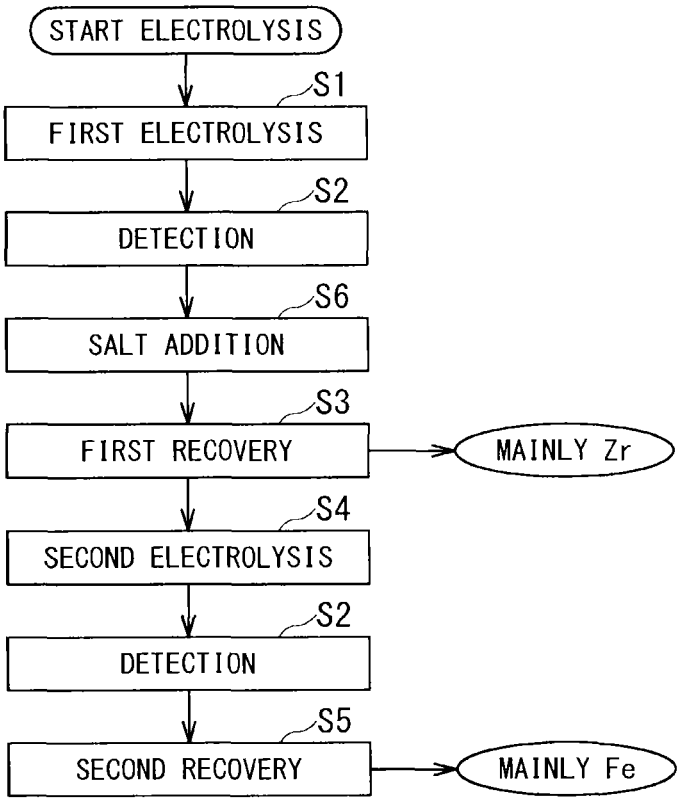
FIG. 7 is a flowchart of the method of separating and recovering metals in the third embodiment.

A third embodiment will be described by using FIGS. 5 to 7. FIG. 5 is a schematic view of a system for separating and recovering metals in the third embodiment. FIG. 6A is a graph of the concentration change of Zr ion in an electrolysis vessel in the third embodiment, FIG. 6B is a graph of the concentration change of Fe ion in the electrolysis vessel in the third embodiment, and FIG. 6C is a graph of the change in anode potential in the third embodiment. FIG. 7 is a flowchart of the method of separating and recovering metals in the third embodiment It is noted that the same configurations as those of the first and second embodiments are given the same reference symbols, thereby omitting overlapping description.

(Electrolysis Apparatus)

Hereafter, a system 10 for separating and recovering metals of the present embodiment will be described. The system 10 for separating and recovering metals of the present embodiment has the same configuration as that of the system 10 for separating and recovering metals in the first embodiment. Further, it includes a salt feed source 26, a salt feed nozzle 24 for feeing a salt of Fe from the salt feed source 26 into the molten salt, and a salt feed control section 25 for controlling the feed of the salt of Fe. The salt feed control section 25 is, for example, a valve provided in the salt feed nozzle 24, and is connected to and controlled by the control section 20. It is noted that the salt of Fe is, for example, $FeCl_2$, and supposed to be a salt of metal which is electrolyzed in the second electrolysis step S4. Further, the salt feed nozzle 24 and the salt feed source 26 are generically referred to as a salt feed unit. The salt feed unit may have any configuration which allows the addition of salt into the molten salt, without being limited to the salt feed nozzle 24 and the salt feed source 26.

(Methodology)

Hereafter, a method of separating and recovering metals of the present embodiment will be described. First, as with the first embodiment, a first electrolysis step S1 is performed and a detection step S2 is performed as needed. The electrolysis progresses and, at time t1, the start of a transition period is detected by the detection step S2. Then, the control section 20 transmits without delay a salt feed signal to the salt feed control section 25. Then, the salt feed control section 25 becomes opened, and salt is added to the molten salt from the salt feed source 26 via the salt feed nozzle 24. The step of adding a salt of a second metal to the molten salt is referred to as a salt addition step S6, and the time at which the salt addition step S6 is performed is let to be time u1. The salt feed control section 25 becomes closed after a fixed time period. Alternatively, it may become closed by a signal from the control section 20. As a result of adding the salt of the second metal, the concentration of Fe ion rapidly increases after the salt addition step S6.

After the salt addition step S6, the first recovery step S3 is performed at time t2. Here, as with the first embodiment, time difference between time t1 and time t2 is preferably as small as possible, and time t2 is supposed to be at least before the concentration of Fe ion reaches an equilibrium. Moreover, time u1 is later than time t1, and is earlier than time t2 or at the same time as time t2.

After the first recovery step S3, as with the first embodiment, molten salt electrolytic treatment is performed, it is detected at time t3 that the concentration change of Fe ion turns from an equilibrium to a decrease, and the second recovery step S5 is performed at time t4.

(Advantageous Effects)

In the present embodiment it is possible to continuously and efficiently recover each component from a target object containing a plurality of metals in the same electrolysis vessel, and since the salt of Fe is added into the molten salt immediately before or concurrently with the first recovery step S3, the time period of the transition period becomes shorter compared to in the first and second embodiments, thus resulting in decrease in the time needed for the entire electrolysis. Moreover, since the time required for the transition period decreases, the amount of Zr that is precipitated in the transition period decreases, and it is possible to recover Fe having higher purity compared to in the first embodiment. Therefore, it is possible to separate and recover high purity Zr and Fe at a higher efficiency.

Fourth Embodiment

Figures 8A, 8B, 8C:
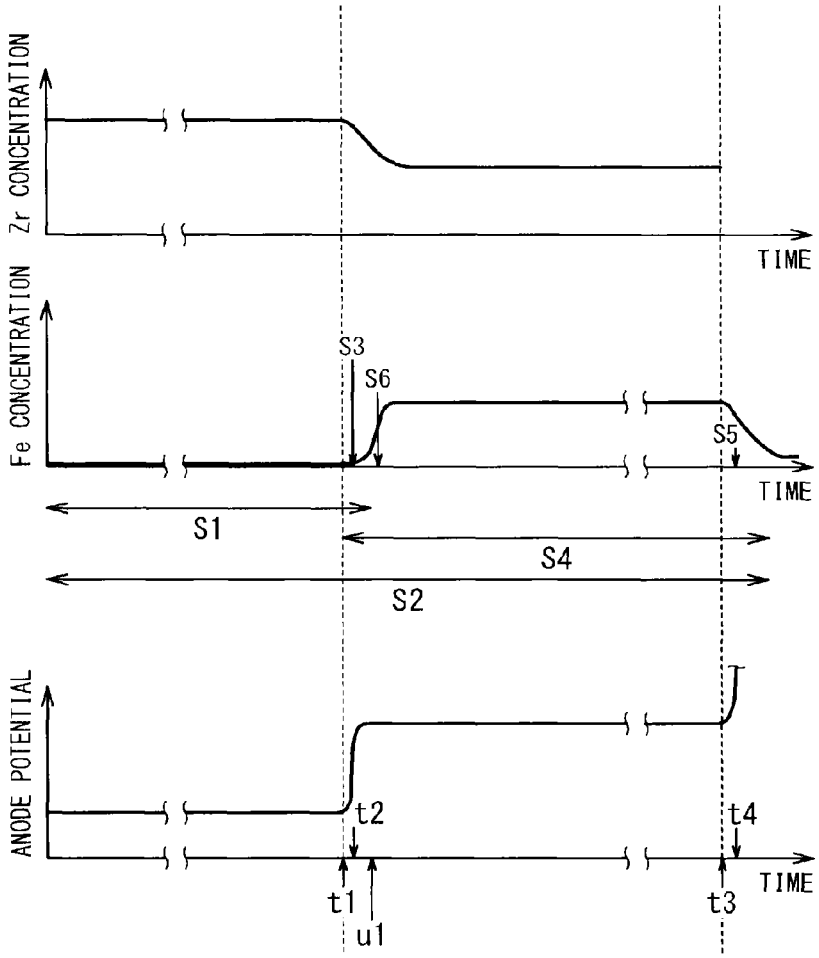
FIG. 8A shows graphs of concentration change of Zr ion in an electrolysis vessel in a fourth embodiment.
FIG. 8B shows graphs of concentration change of Fe ion in the electrolysis vessel in the fourth embodiment.
FIG. 8C shows graphs of change in anode potential in the fourth embodiment.
Figure 9:
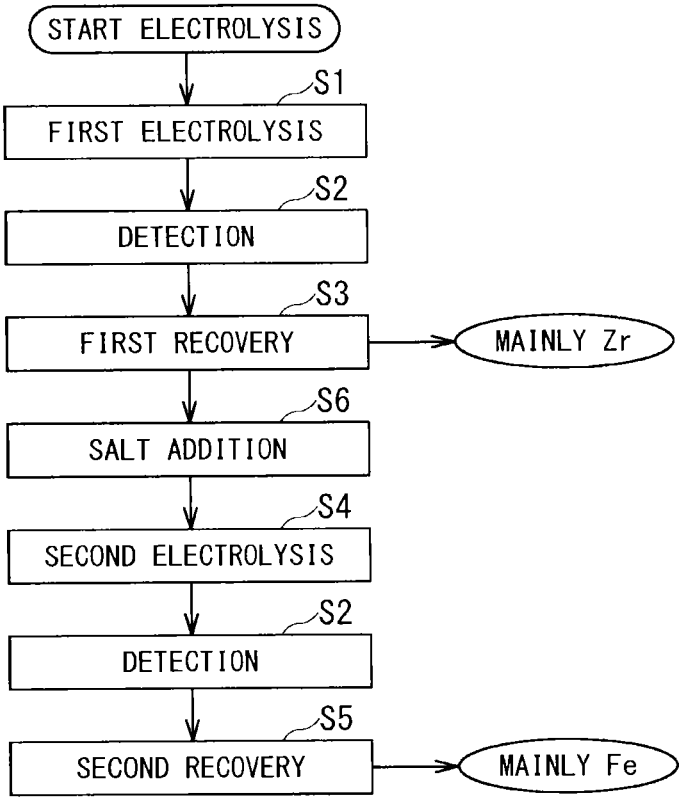
FIG. 9 is a flowchart of the method of separating and recovering metals in the fourth embodiment.

A fourth embodiment will be described by using FIGS. 8 and 9. FIG. 8A is a graph of the concentration change of Zr ion in an electrolysis vessel in the fourth embodiment, FIG. 8B is a graph of the concentration change of Fe ion in the electrolysis vessel in the fourth embodiment, and FIG. 80 is a graph of the change in anode potential in the fourth embodiment. FIG. 9 is a flowchart of the method of separating and recovering metals in the fourth embodiment.

It is noted that the same configurations as those of the first to third embodiments are given the same reference symbols, thereby omitting overlapping description. The configuration of the system 10 for separating and recovering metals in the present embodiment is the same as that of the third embodiment.

(Methodology)

Hereafter, a method of separating and recovering metals of the present embodiment will be described. First, as with the first embodiment, a first electrolysis step S1 is performed and a detection step S2 is performed as needed. The electrolysis progresses and, at time t1, the start of a transition period is detected by the detection step S2. Then, a recovery signal is transmitted without delay from the control section 20 to the recovery unit 21, and at time t2, the first recovery step S3 is performed. When the first recovery step S3 is performed, the control section 20 transmits without delay a salt feed signal to the salt feed control section 25, and a salt addition step S6 is performed at time u1.

The time difference between time t1 and time t2 is preferably as small as possible, and time t2 is supposed to be at least before the concentration of Fe ion reaches an equilibrium. Moreover, the time difference between time t2 and time u1 is preferably as small as possible, and time u1 is supposed to be at least before the concentration of Fe ion reaches an equilibrium.

After the salt addition step S6, as with after the first recovery step S3 of the first embodiment, molten salt electrolysis is performed. At time t3, it is detected that the concentration change of Fe ion turns from an equilibrium to a decrease, and at time t4, the second recovery step S5 is performed.

(Advantageous Effects)

In the present embodiment it is possible to continuously and efficiently recover each component from a target object containing a plurality of metals in the same electrolysis vessel, and since Zr is recovered without delay after the start of the transition period, high purity Zr can be obtained.

Moreover, in the present embodiment, since the salt of Fe is added without delay after the first recovery step S3 to reduce the time required for the transition period, the amount of Zr that is precipitated in the transition period is decreased. Therefore, it is possible to efficiently recover high purity Fe.

Although some embodiments of the present invention have been described, these embodiments are presented by way of examples and are not intended to limit the scope of the invention. These novel embodiments can be carried out in other various forms, and various omissions, replacements, and modifications can be made thereto without departing from the spirit of the invention. These embodiments and their variations shall be included in the scope and spirit of the invention, and also in the range of invention and its equivalents recited in the claims of the patent.

For example, the target object is not limited to molten fuels, and may be any other material provided that it contains a plurality of metals.

Moreover, when a part of a base metal is present in the target object in such a way to be surrounded by a noble metal without being in contact with a molten salt, it is probable that electrolysis of the noble metal is started with the base metal remaining in the target object. In such a case, when the electrolysis of the noble metal progresses and the base metal comes into contact with the molten salt, the separation and recovery of metals may be repeated from the first electrolysis step S1 such as by replacing the electrolysis vessel and the molten salt.

Moreover, when performing the first recovery step S3, the electrolysis may be temporarily stopped and after the recovery, the electrolysis may be restarted with a similar current value.

Moreover, although it was supposed that the detection of concentration changes of ions in the molten salt and the operation of the recovery unit 21 based on the detection, as well as the ON/OFF control of the power supply 22 be performed by the control section 20 from first to last, these control may be performed by a human. In such a case, the control section 20 performs the judgment of timing suitable for recovery based on the change in ion concentration in the molten salt, and an operator performs control of the recovery unit and the electrode power supply based on the judgment of the control section 20.

Moreover, to achieve a desired processing speed, the current value may be changed in each of the first electrolysis step S1 and the second electrolysis step S4 by manipulating the current control section 16. For example, a current with a higher value than before may be applied between electrodes in response to a detection of the start of the transition period. Thus, it becomes possible to increase the precipitation speed of the recovered substance in the second recovery step S5.

Further, although it has been stated that the current flowing between electrodes is controlled at a constant current in any of the embodiments, the current value may be made variable to achieve a desired precipitation speed. For example, when it is desired to increase the precipitation speed of Fe, the current value from the first recovery step S3 to the second recovery step S5 is set to a value higher than before.

Moreover, in any of the embodiments, the precipitated substance in the first electrolysis step S1 is recovered before the start of the transition period. The recovery of precipitated substance to be performed before the start of a transition period is referred to as a preliminary recovery step. It is supposed that the preliminary recovery step is, for example, performed at fixed time intervals until the start of the transition period is detected by using a timer or the like. Since the recovered substance in the preliminary recovery step does not contain the precipitated substance of the transition period, it is possible to recover a high-purity precipitated substance. Further, it is supposed that after a detection of the start of a transition period, any of the first to the fourth embodiments is carried out.

What is claimed is:

1. A method of separating and recovering metals, whereby a mixture containing at least a first metal and a second metal, the second metal having a higher standard electrode potential than that of the first metal, is connected to an anode in a molten salt, and the first metal and the second metal are precipitated on a cathode in the molten salt by electrolysis, the method of separating and recovering metals comprising:

a detection step of detecting a concentration change in each of a first metal ion and a second metal ion in the molten salt by a concentration change detection unit;

a first electrolysis step of electrolyzing the first metal;

a first recovery step of recovering a precipitated substance according to a detection in which a concentration decrease of the first metal ion, which is predefined in the concentration change detection unit, is detected in the detection step;

a second electrolysis step of electrolyzing the second metal;

a second recovery step of recovering a precipitated substance subsequent to the first recovery step; and a salt addition step of adding a salt of the second metal to the molten salt after a concentration decrease of the first metal ion, which is predefined in the concentration change detection unit, is detected in the detection step, and before the first recovery step is performed.

2. The method of separating and recovering metals according to claim 1, wherein the first recovery step is performed after a concentration decrease of the first metal ion, which is predefined in the concentration change detection unit, is detected in the detection step and before the concentration of the second metal ion reaches an equilibrium.

3. The method of separating and recovering metals according to claim 1, wherein the first recovery step is performed after the concentration of the second metal ion reaches an equilibrium in the detection step.

4. The method of separating and recovering metals according to claim 1, further comprising:

a preliminary recovery step of recovering a precipitated substance before a concentration decrease of the first metal ion, which is predefined in the concentration change detection unit, is detected in the detection step.

5. The method of separating and recovering metals according to claim 1, wherein in the detection step, the concentration change detection unit detects a concentration change of each of the first metal ion and the second metal ion in the molten salt by measuring a potential change of the anode.

6. The method of separating and recovering metals according to claim 1, wherein in the detection step, the concentration change detection unit detects a concentration change of each of the first metal ion and the second metal ion in the molten salt by performing component analysis of the molten salt.

7. A method of separating and recovering metals, whereby a mixture containing at least a first metal and a second metal, the second metal having a higher standard electrode potential than that of the first metal, is connected to an anode in a molten salt, and the first metal and the second metal are precipitated on a cathode in the molten salt by electrolysis, the method of separating and recovering metals comprising:

a detection step of detecting a concentration change in each of a first metal ion and a second metal ion in the molten salt by a concentration change detection unit;

a first electrolysis step of electrolyzing the first metal;

a first recovery step of recovering a precipitated substance according to a detection in which a concentration decrease of the first metal ion, which is predefined in the concentration change detection unit, is detected in the detection step;

a second electrolysis step of electrolyzing the second metal;

a second recovery step of recovering a precipitated substance subsequent to the first recovery step; and a salt addition step of adding a salt of the second metal to the molten salt after the first recovery step is performed and before the concentration of the second metal ion reaches an equilibrium in the detection step.

8. The method of separating and recovering metals according to claim 7, further comprising:

a preliminary recovery step of recovering a precipitated substance before a concentration decrease of the first metal ion, which is predefined in the concentration change detection unit, is detected in the detection step.

9. The method of separating and recovering metals according to claim 7, wherein in the detection step, the concentration change detection unit detects a concentration change of each of the first metal ion and the second metal ion in the molten salt by measuring a potential change of the anode.

10. The method of separating and recovering metals according to claim 5, wherein in the detection step, the concentration change detection unit detects a concentration change of each of the first metal ion and the second metal ion in the molten salt by performing component analysis of the molten salt.

* * * * *